United States Patent [19]

Capawana

[11] Patent Number: 4,903,575

[45] Date of Patent: Feb. 27, 1990

[54] MACHINEGUN AMMUNITION CONTAINER

[76] Inventor: Ross Capawana, 3250 Pollux Ave., Las Vegas, Nev. 89102

[21] Appl. No.: 190,023

[22] Filed: May 4, 1988

Related U.S. Application Data

[63] Continuation-in-part of Ser. No. 162,098, Feb. 29, 1988, which is a continuation-in-part of Ser. No. 929,339, Nov. 12, 1986, abandoned.

[51] Int. Cl.[4] ..... F41C 25/04

[52] U.S. Cl. ..... 89/34; 42/50

[58] Field of Search ..... 89/34, 33.2, 33.1, 33.14; 42/49.01, 49.02, 50

[56] References Cited

U.S. PATENT DOCUMENTS

| | | | |
|---|---|---|---|
| 186,308 | 1/1877 | Crispin . | |
| 269,100 | 12/1882 | Palliser . | |
| 518,821 | 4/1894 | Mannlicher | 42/50 |
| 2,137,259 | 11/1938 | Boak . | |
| 2,372,614 | 3/1945 | Swebilius | 42/50 |
| 2,434,269 | 1/1948 | Harvey | 42/50 |
| 2,486,949 | 11/1949 | Hutchison | 89/34 |
| 2,573,774 | 11/1951 | Sandberg | 89/34 |
| 2,712,705 | 7/1955 | Amant | 42/50 |
| 3,004,361 | 10/1961 | Hammer . | |
| 3,293,986 | 12/1966 | Stoner | 89/34 |
| 3,373,521 | 3/1968 | Into | 42/50 |
| 3,509,654 | 5/1970 | Vorgrimler | 42/50 |
| 3,711,981 | 1/1973 | Seecamp | 42/50 |
| 3,736,686 | 6/1973 | Moller et al. | 42/50 |
| 3,991,928 | 11/1976 | Friedrich et al. | 228/190 |
| 4,107,862 | 8/1978 | Sofinowski | 42/50 |
| 4,152,857 | 5/1979 | Ketterer | 42/50 |
| 4,301,711 | 11/1981 | Vonlanthen et al. | 89/33.14 |
| 4,641,450 | 2/1987 | Moll et al. | 89/16 |
| 4,658,700 | 4/1987 | Sullivan | 89/33.02 |
| 4,722,825 | 2/1988 | Goldstein | 89/16 |
| 4,756,677 | 7/1988 | Hribernik et al. | 89/16 |
| 4,765,081 | 8/1988 | Dieringer | 42/50 |
| 4,776,122 | 10/1988 | Dieringer et al. | 42/50 |

FOREIGN PATENT DOCUMENTS

| | | | |
|---|---|---|---|
| 494795 | 9/1919 | France | 42/50 |
| 282209 | 9/1934 | Italy | 89/14.05 |
| 482212 | 3/1938 | United Kingdom | 89/33.1 |
| 573600 | 11/1945 | United Kingdom | 42/50 |

*Primary Examiner*—Deborah L. Kyle
*Assistant Examiner*—Stephen Johnson
*Attorney, Agent, or Firm*—Quirk, Tratos & Roethel

[57] ABSTRACT

An M-60 machinegun ammunition container has a mounting strap spaced from a container wall which removably mounts on the bandolier supporter of the gun. Stabilizing bosses extend inwardly from the mounting strap to prevent the container from moving. Biasing means, which may be pleats in the molded side or end walls of the container, urge the side walls together to preclude ammunition from rattling in the container.

13 Claims, 8 Drawing Sheets

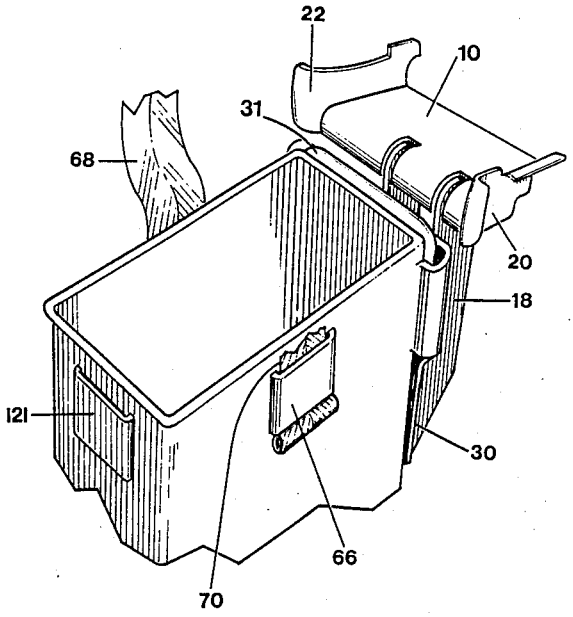
FIG. 2
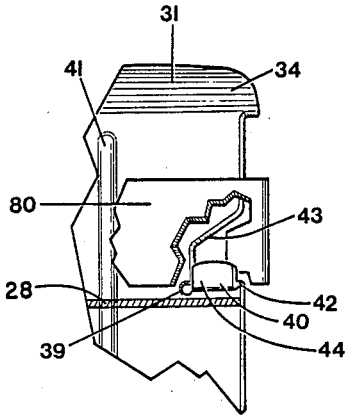
FIG. 3
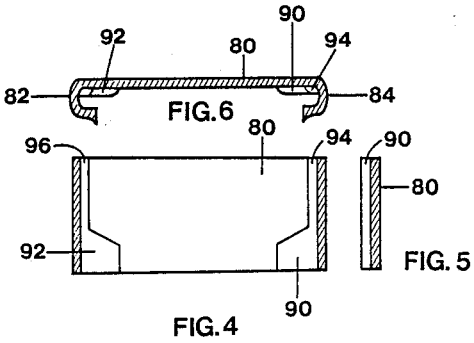

MACHINEGUN AMMUNITION CONTAINER

RELATIONSHIP TO OTHER APPLICATIONS

This application is a continuation-in-part of application Ser. No. 162,098 filed Feb. 29, 1988 entitled Machinegun Ammunition Container, which is a continuation-in-part of application Ser. No. 929,339, filed Nov. 12, 1986, having the same title.

BACKGROUND OF THE INVENTION

This invention relates to a magazine for holding machinegun ammunition. More particularly, the invention relates to a molded rigid plastic container having an integral strap adapted to fit on a bandolier supporter for an M-60 machinegun.

The M-60 machinegun, manufactured by Maremont Corporation of Saco, Me., has been an important military and police weapon for many years, and is widely used by the armed forces of the United States and many other countries. The M-60 machinegun and its operation are described in detail in Department of the Army Field Manual FM 23-67 entitled "Machinegun 7.62-MM, M-60", issued by the Department of the Army, U.S.A., October, 1964. While this weapon has proved to be very effective, occasionally problems exist with the ammunition feed system. Ammunition is packaged in 100 round belts or bandoliers packaged in cardboard boxes which are placed in a cloth sack and are attached to the feed tray of the machinegun with a webbed belt. The cardboard box must be torn open prior to inserting into the sack, and this is sometimes a difficult act in the field. In addition, the mounting of the cardboard box on the side of the gun provides a flexible, somewhat unstable structure which can possibly cause a jam in the gun during strenuous usage. Furthermore, in wet climates, the box sometimes tends to disintegrate. Also, once a box of ammunition is partially used, it cannot be resealed to keep out moisture and debris. The problems with existing machinegun magazines are noted in an article entitled "A Magazine for the Machinegun" in INFANTRY magazine, November/December 1985 issue, page 18.

The invention provides a container for M-60 machinegun ammunition that provides substantial advantages in terms of cost, reliability, and operability. The container is a single-piece, molded plastic box having a cover which is either hinged or slideably removable. The box has a mounting strap or hanger which fits over the existing bandolier supporter and automatically locks into place, resulting in a stable structure which insures that an jam will not be caused by the ammunition container under strenuous usage. Since the box is made from plastic, it does not disintegrate when wet, and can be made from a transparent material for easy viewing of the amount of ammunition left in the box. The container of the invention is easier and faster to load than the existing system, since it is entirely rigid and slides on quickly without the necessity of wrapping a flexible strap in place around the bandolier supporter. In addition, since the container has a quickly replaceable top, the amount of moisture and debris which is likely to enter the container in field usage can be minimized. It has also been found that the ammunition belt has less friction sliding over the plastic box than a cloth bag, and operation of the gun with the container of the invention is quieter, since the container helps to maintain tension on the ammunition belt. In addition, if necessary the containers of the invention can be reused.

Various designs for machinegun ammunition containers exist in the prior art. For example, Stoner, U.S. Pat. No. 3,293,986, and Sandberg, U.S. Pat. No. 2,573,774, each show containers for belted ammunition which are adapted to be gun-mounted. However, neither design is useful for an M-60 machinegun.

In general, the ammunition container of the invention is adapted to fit over the existing bandolier supporter mounted on the side of the M-60 machinegun. The container has a molded strap spaced from the box and extending around a portion of the forward exterior periphery of the box. The strap is configured with internal bosses adapted to mate with indentations on the existing bandolier supporter, and is configured to lock into place on the bandolier supporter to preclude rotational or vertical movement.

Accordingly, it is an object of the invention to provide an ammunition container for the M-60 machinegun which is simple and inexpensive to manufacture, and which reliably provides a rigid, non-movable support for ammunition belts. It is also an object to provide a container having inwardly biased side walls to prevent the bullets from moving inside the container, thus producing noise. It is another object of the invention to provide an ammunition container which does not deteriorate in field usage, and which reduces the amount of moisture and debris which can enter the container with a risk of corroding or clogging the gun. It is yet another object of the invention to provide an ammunition container which can be easily and rapidly mounted and dismounted from the gun, yet which provides a firm, stable structure while in place. These and other objects are satisfied by the container of the invention, a detailed description of which is provided herein.

BRIEF SUMMARY OF THE INVENTION

An ammunition container for M-60 machinegun ammunition belts comprises a rigid, molded plastic box having a width slightly greater than the length of a machinegun bullet. The box has an exterior mounting strap spaced from an end portion of the box, the strap being engageable with the bandolier supporter of the machinegun by sliding the strap over the top portion of the supporter. A series of bosses or projections on an interior surface of the mounting strap of the container mate with existing indentations on the bandolier supporter, providing a locking interengaging fit of the strap to the machinegun. A cap is attached to the box, either by a molded hinge at a rear portion of the box or by means of channels along the sides of the top which slideably engage flanges along the box periphery.

BRIEF DESCRIPTION OF THE DRAWINGS

The invention is best understood with respect to the drawings, in which:

FIG. 2 is a partial perspective view showing the mounting mechanism;

FIG. 3 is a partial cutaway view showing the particular engagement of the mounting strap of the container wit the bandolier supporter;

FIGS. 4, 5, and 6 are a partially sectioned inside view, end view, and top view, respectively, of the container mounting strap;

DETAILED DESCRIPTION OF A PREFERRED EMBODIMENT

Figure 1:
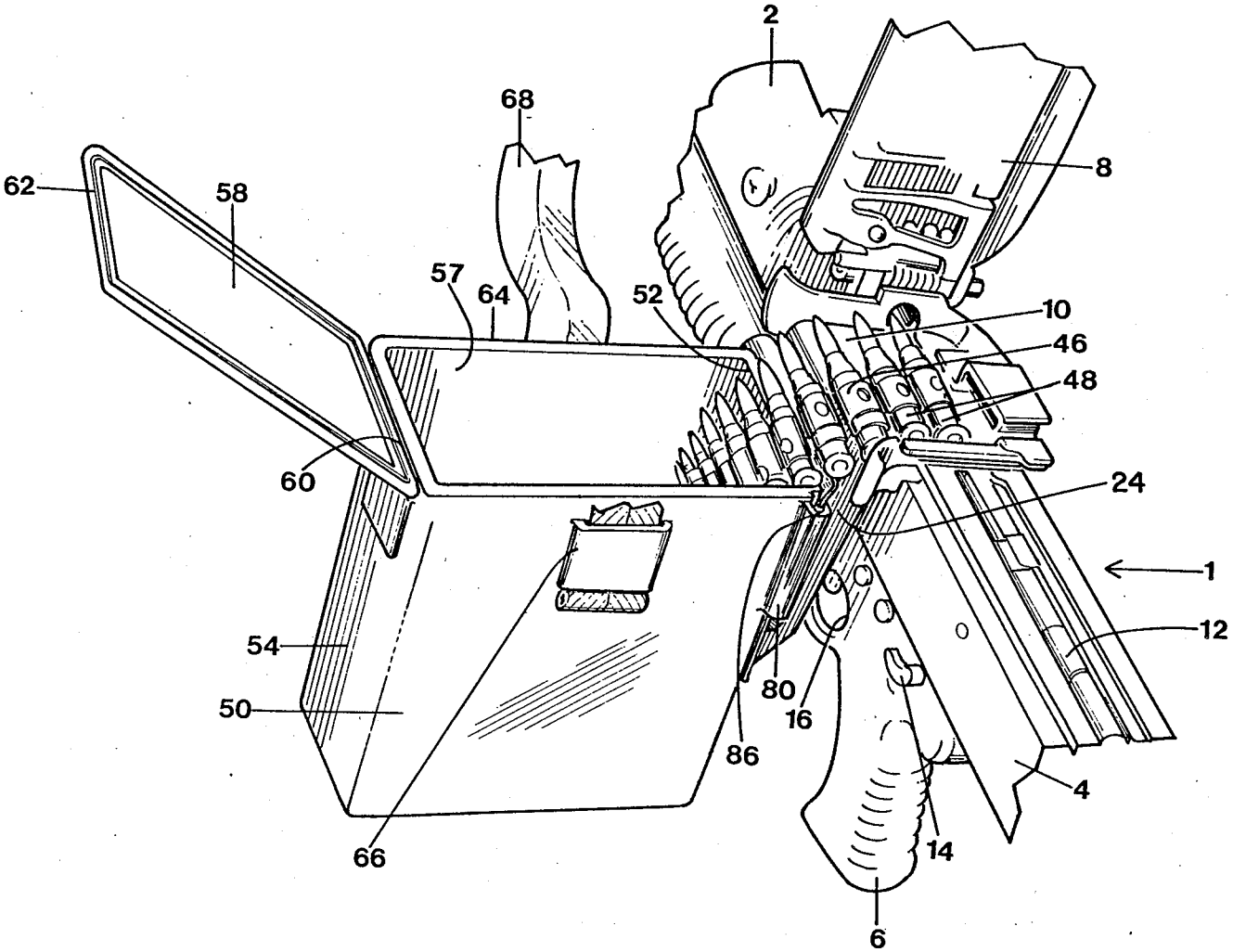
FIG. 1 is a perspective view showing a container of the invention mounted on the side of an M-60 machinegun.

Referring first to FIG. 1, M-60 machinegun 1 is a conventional 7.62-MM, M-60 machinegun manufactured by Maremont Corp. The gun has a barrel 2, a receiver 4, a handle 6, a feed cover assembly 8, and a bolt 12. A safety 14 precludes operation of the trigger 16 except when the gun is desired to be placed in operating mode.

A bandolier or belt 46 of machinegun bullets 48 is fed to the feed port of the gun over rollers 18 (see FIG. 2) of feed tray 10. A pair of vertical ammunition guides 20 and 22 on each side of the feed tray guide the ammunition into the feed tray groove.

The bandolier supporter 24 is mounted on the side of the machinegun adjacent to and below the feed tray 10. The support is a conventional portion of the M-60 machinegun, and, as best seen in FIGS. 2 and 3, consists of a vertical mounting plate 30 spaced from a hanger member 24 which depends from the feed tray. A horizontal spacing ledge 28 extends outwardly from a machinegun and separates the vertical mounting plate from the feed tray. A sloped upper guide portion 31 of the mounting plate acts as a guide for the ammunition belt as it exits the container. A pair of ears 32 and 34 at the sides of guide portion 31 are designed to hold the flexible belt from the conventional sack into which boxes of ammunition are placed; while these ears exist on the ends of the bandolier supporter as it is manufactured commercially, they provide no function with respect to the container of the invention other than to assist in guiding the mounting bracket of the container into its proper position for loading.

As constructed by the manufacturer, the bandolier supporter also has two identical indentations just above the spacer 28 on either side of the supporter; one of the indentations 43 is shown in FIG. 3. The indentation is a notch in the upper portion 36 of the vertical mounting plate 30; a lug or tooth 40 consisting of a horizontal ledge 42 and a vertical flange 44 extend rearwardly (i.e., toward the machinegun) from the mounting plate 30. A small circular aperture 39 is located at a bottom portion of the notch 43; this aperture remains from the manufacturing process for the bandolier supporter and has no function in its use. An identical notch and tooth support exists on the opposite side of the bandolier supporter. Similarly, a pair of vertical structural ribs (one of which is shown as 41 in FIG. 3) exist on the conventional supporter.

The ammunition container 50 of the invention is a rectangular box having a bottom wall 51, a front wall 52, a rear wall 54, and side wall 56 and 57. A flat top provides a cover means to enclose the interior chamber of the box; the top is attached to the remainder of the container by a flexible hinge member 60. The hinge is simply a flexible piece of plastic molded between the container and the top. The entire box is a one piece unit molded from plastic, such as polyethylene, polypropylene, polyvinylchloride, or polycarbonate. The preferred material of manufacture is polypropylene. A rectangular continuous groove 62 around the inside portion of the covering member 58 press fits to the peripheral lip 64 of the container. When the top is closed and pressed onto the bottom portion of the container, the edges of the peripheral groove grip the top of the container and the top is maintained in place by friction. No separate latches or locks are required.

A carrying strap 68 is conventionally mounted in a pair of strap holders 68, which are simply molded loops in each side of the container. Any type of mounting means for the strap is acceptable. Another strap mount 121 is mounted at the rear of the container; this mount may also be used for attaching a second ammunition container.

A very important part of the ammunition container of the invention is the mounting means for removably attaching the container to the machinegun. The mounting bracket, best seen is FIGS. 2–6, consists of an arm 80 parallel to and spaced from the front wall 52 of the container thus forming a narrow slot to receive the mounting plate of the bandolier supporter. Mounting bracket 80 has a pair of U-shaped end portions 82 and 84 (best seen in FIG. 6) which attach to side walls 57 and 56, respectively, at 88 and 86. Accordingly, the slot for receiving the bandolier supporter maintains a uniform width along the entire front wall of the container.

As shown in FIGS. 3–6, a pair of lugs or bosses 90 and 92 having "h" shapes corresponding to the shape of the notches in the bandolier supporter are molded into the inside portion of the mounting bracket 80. The lower portion of the bosses matches the notches, while the upper portions 94 and 96 of the bosses act as centering guides for mounting plate 30 of the bandolier supporter. When the container is fixed in position on the machinegun as shown in FIGS. 1 and 2, the lower portion of the bosses extends into the notch in the mounting plate, and the edge of the mounting plate abuts the interior edge of the upper portions 94 and 96 of the bosses. Consequently, the space between the upper portion of the bosses is equal to the width of the mounting plate. Accordingly, when the container mounting bracket is slideably engaged with the mounting plate of the bandolier supporter, the container locks into position automatically when the bosses engage the notches on either side of the mounting plate. The bosses provide a stabilizing means for precluding undesirable movement of the container while the gun is in use. The width of the slot between the mounting bracket 80 and the front wall 52 of the container is approximately ⅛"; the thickness of bosses 90 and 92 is approximately 1/16". The entire container is approximately 6"×5"×3" in size.

Figure 7:
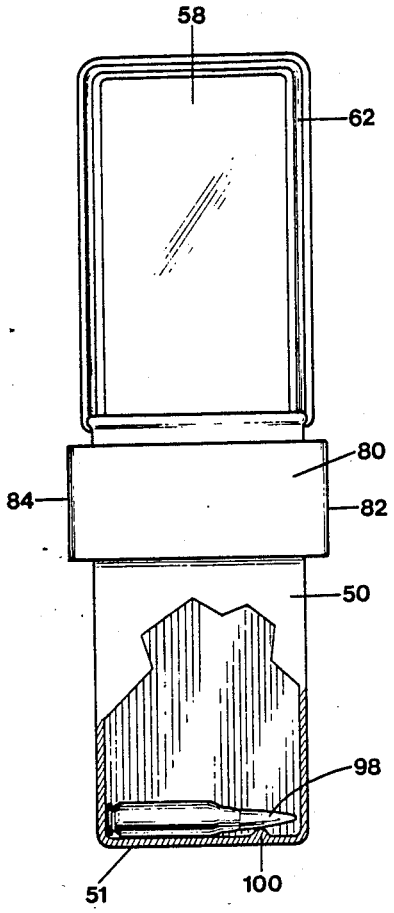
FIG. 7 is a front view of the container partially cutaway to show a bullet resting in the container.

The cutaway drawing in FIG. 7 shows the existence of a longitudinally transverse mounting rib 100 which extends between the front and rear walls along the bottom of the container. The rib is designed to support the nose portion of the bullet 98 to maintain the axis horizontal. This feature simply assists in maintaining a problem-free feed for the gun, and also leaves a small area at the bottom of the container where particulate matter and moisture can collect without affecting the bottom row of bullets.

Figure 8:
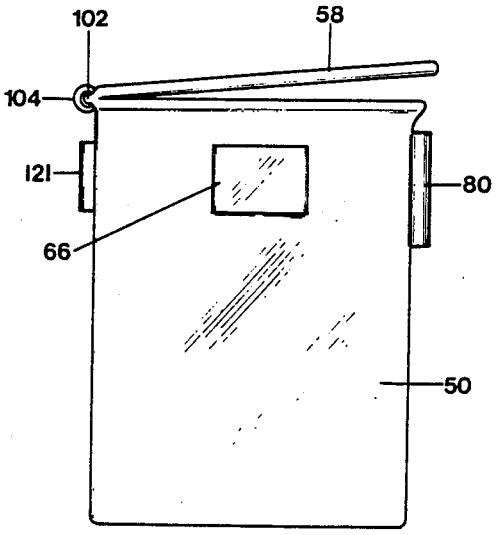
FIG. 8 is a side view of the container.
Figure 9:
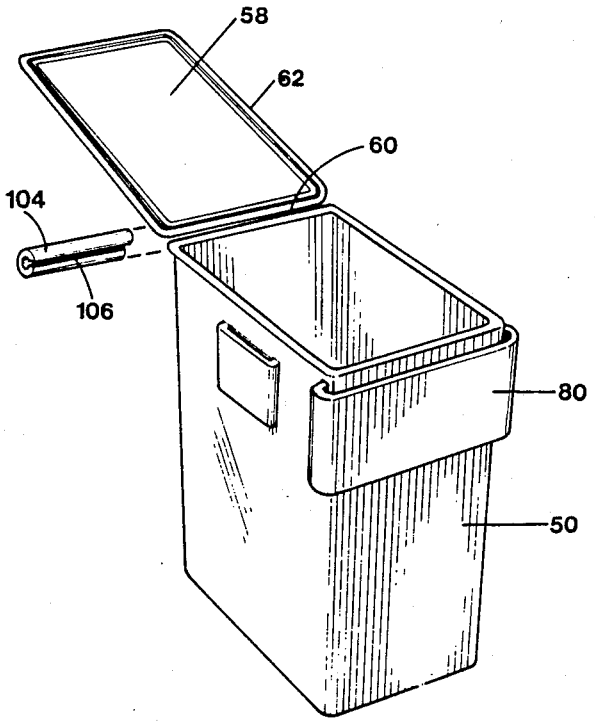
FIG. 9 is a perspective view of the container showing the spring clip in exploded view.
Figure 10:
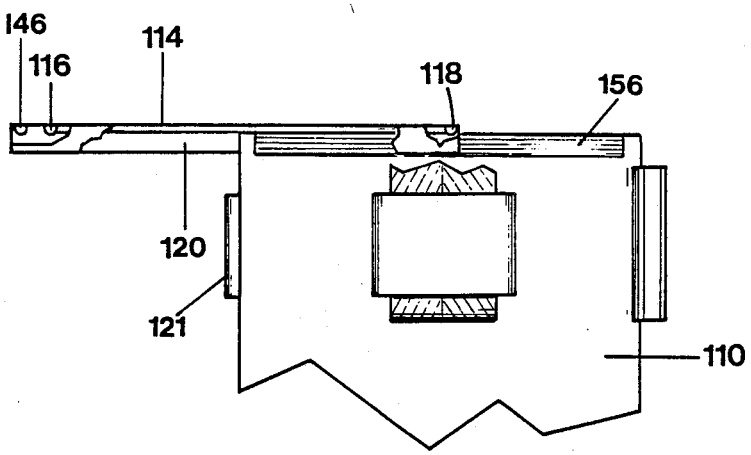
FIG. 10 is a partial side view of an alternate embodiment of the invention showing a different type of top.
Figure 11:
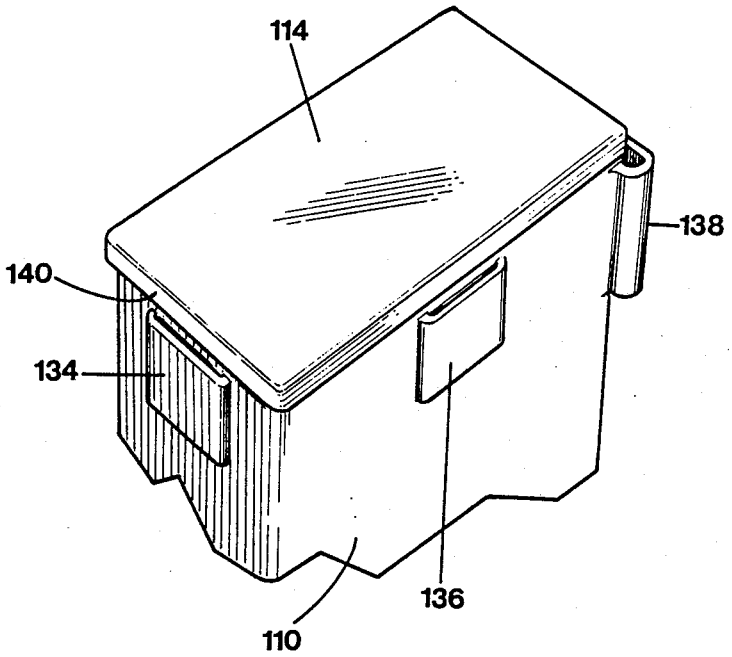
FIG. 11 is a perspective top view of the embodiment shown in FIG. 10.
Figure 12:
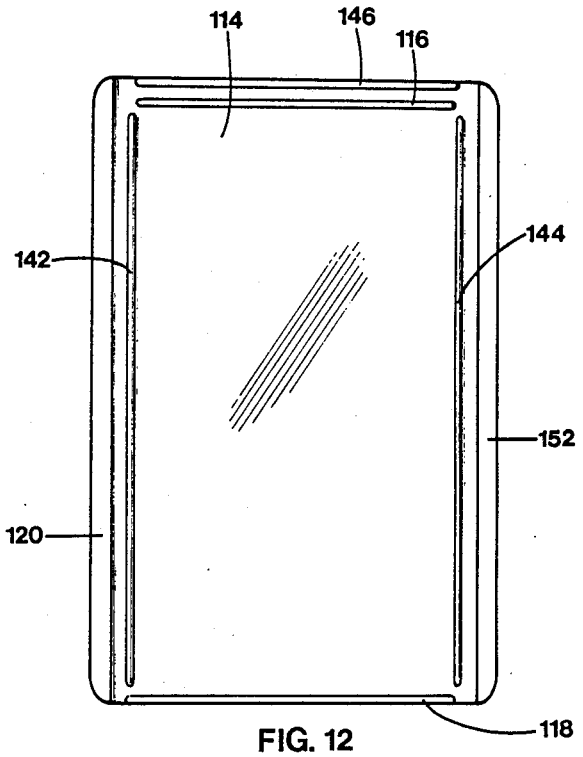
FIG. 12 is a bottom view of the cover of the embodiment of FIG. 10.
Figure 13:
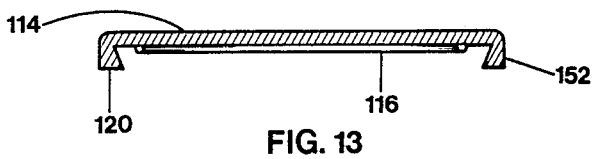
FIG. 13 is a transverse section of the cover of FIG. 12.

As shown in FIGS. 8 and 9, in one embodiment of the invention the cover or cap 58 is hinged at its rear portion by means of a molded web connecting the base of the container with the top. If desired, the cap may be biased to a closed position by sliding an elongate C-shaped clip 104 over the bead 102 at the rear portion of the container. As shown in FIG. 9, the C-shaped clip has a channel 106 which slides over the webbed member and biases the cap into the closed position. When the container is attached to the gun for use, the clip is removed and discarded.

An alternate, and preferred, embodiment of the cap for the container of the invention is shown in FIGS. 10–13. The container 110 has an outwardly extending lip 156 around the periphery of the container. The container has a bandolier hanger 138, and strap mount, and a rear bracket 134. The top 114 has a downwardly extending peripheral lip 140 around the side and rear edges. The top 114 of the container also has a pair of C-shaped side channels 120 (see FIG. 13) which slideably engage the sides of the peripheral lip. A pair of rear ribs or beads 116 and 146, extend transversely between the sides of the top at the rear. A similar transverse bead 118 protrudes downwardly at the front of the top. When the top is completely closed, beads 118 and 116 extend over the front and rear ends of the box. These beads act as stops to maintain the cover in place, but can be easily overcome by exerting slight downward pressure on the center of the cover prior to removing the cover. Longitudinal beads 142 and 144 extend parallel to flanges 120 and 152 and form a channel to slideably receive the upper peripheral side edges 156 of the container.

Figure 14:
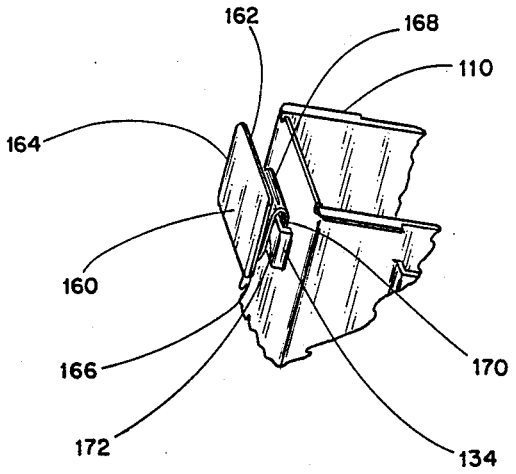
FIG. 14 is a partial view of the rear of the container having a hanger for a second similar ammunition case.

FIG. 14 shows an embodiment of the invention in which a second ammunition container may be mounted in tandem with the use of a simple clip or hanger which mounts at the rear of a container. In the drawing, container 110 has a rear bracket 134 consisting of a spaced arm 170. A removable container hanger has a flat, rectangular mounting plate 160 having parallel side edges 164 and 166, and top edge 162. A hanger portion 168 consisting of an inverted U-shaped member attaches to the rear of plate 160. The U-shaped clip slides over the arm 170 of the mounting bracket, as shown, with mounting plate 160 aligning parallel to the rear wall of container 110. A second container identical to 110 may be attached to the mounting plate, with the bandolier hanger 138 extending over the plate. In this manner, two containers may be easily transported together for rapid exchange.

Figure 15:
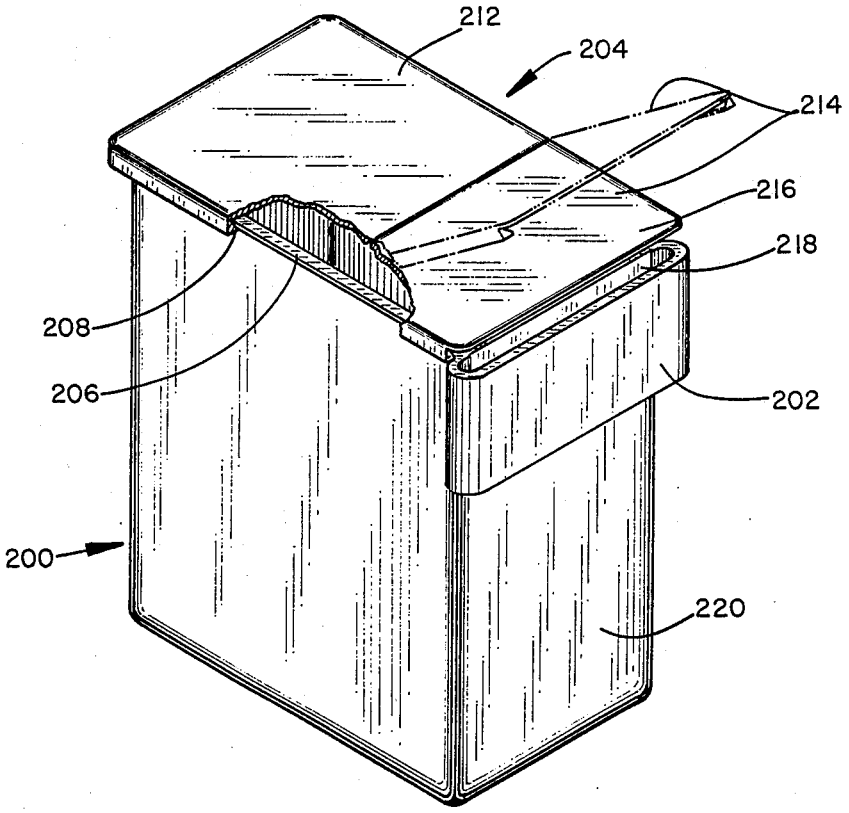
FIG. 15 is a perspective view, partially cut away, of a third embodiment of the invention having a hinged cover which opens automatically upon mounting the container on the gun.

Another embodiment of the ammunition container of the invention is shown in FIG. 15. In this embodiment, the container 200 having a bandolier strap 202 have a design similar to those shown in previous drawings, except that the unit is constructed without a strap hanger and therefor has a continuous bead or ledge 206 along each of the upper peripheral side edges of the container. A cover 204 is slideably attached to the container, with flange 208 slideably mounted along the bead 206. The cover is designed with a transverse crease 210 extending across its entire width at a location slightly forward of the middle of the cover. The crease 210 acts as a hinge, separating the rear portion 212 of the cover from the forward portion 214. A forward lip of the cover 216 extends outwardly over the front wall 220 of the container, and is particularly located over the slot 220 in the bandolier mounting strap when the cover is in the closed position as shown in FIG. 15. The advantage of this design is that the operator of the machinegun not need be concerned about opening the container either before or after the container is in place on the bandolier supporter. When the unit is forced into place on the bandolier supporter, the upper edge of the guide portion of the vertical mounting plate on the bandolier supporter (best seen in FIGS. 2 and 3) contacts the bottom of the lip 216 of the cover. This forces the flange 208 of the forward portion of the cover out of engagement with the bead on the side of the box, popping the forward portion of the cover into an open position as shown in phantom in FIG. 15. Accordingly, the container cover is automatically opened whenever the unit is placed on the machinegun. This efficiency can be very important under battle conditions. Of course, other means of maintaining the forward portion of the container in closed position may be used in accordance with this embodiment of the invention, provided that the forward portion of the cover opens automatically upon placement of the container on the M-60 bandolier supporter.

Figure 16:
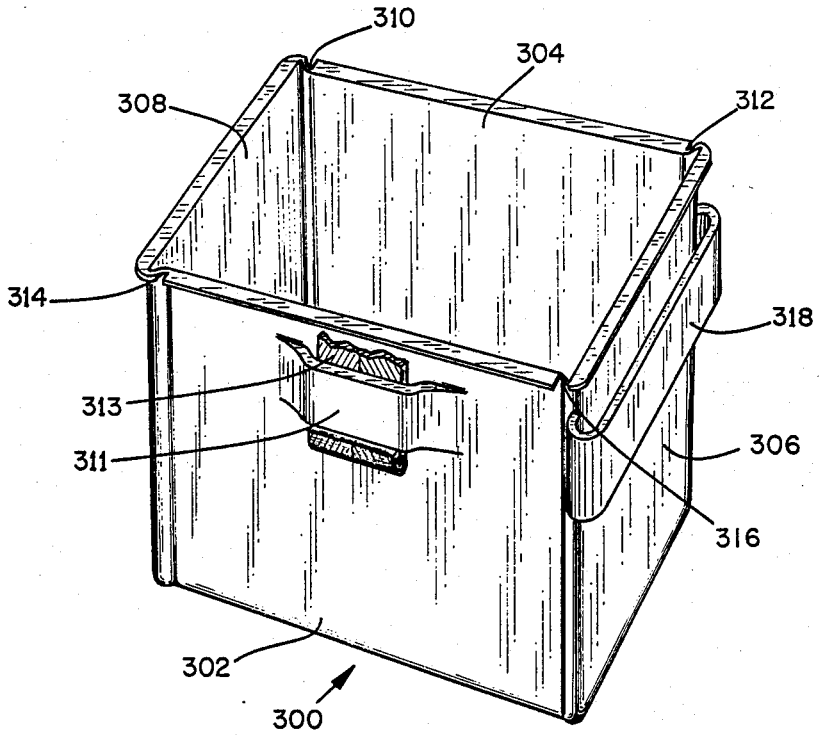
FIG. 16 is a perspective view of a fourth embodiment of the invention showing a container having inwardly biased side walls to prevent ammunition from jiggling in the container.
Figure 17:
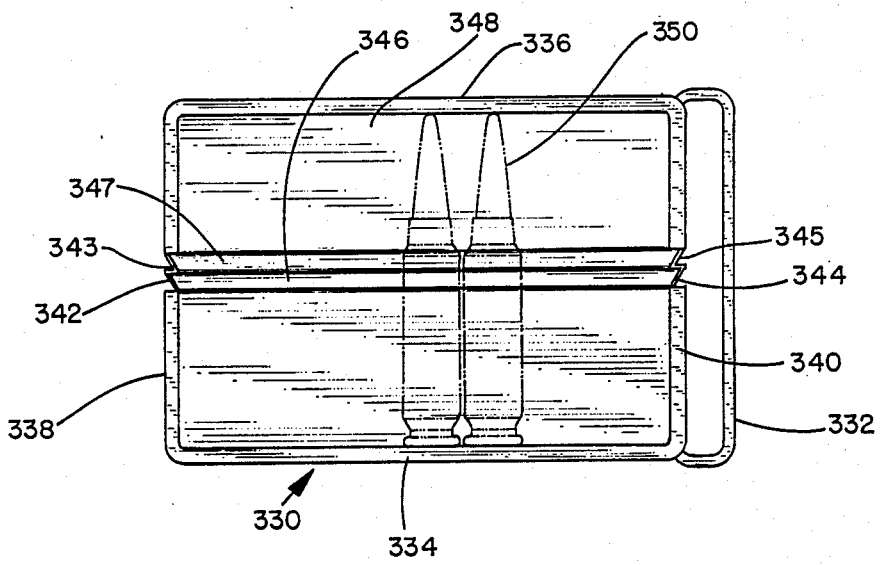
FIG. 17 shows a top view of a variation of the embodiment of FIG. 16 having molded pleats in the container end walls.
Figure 18:
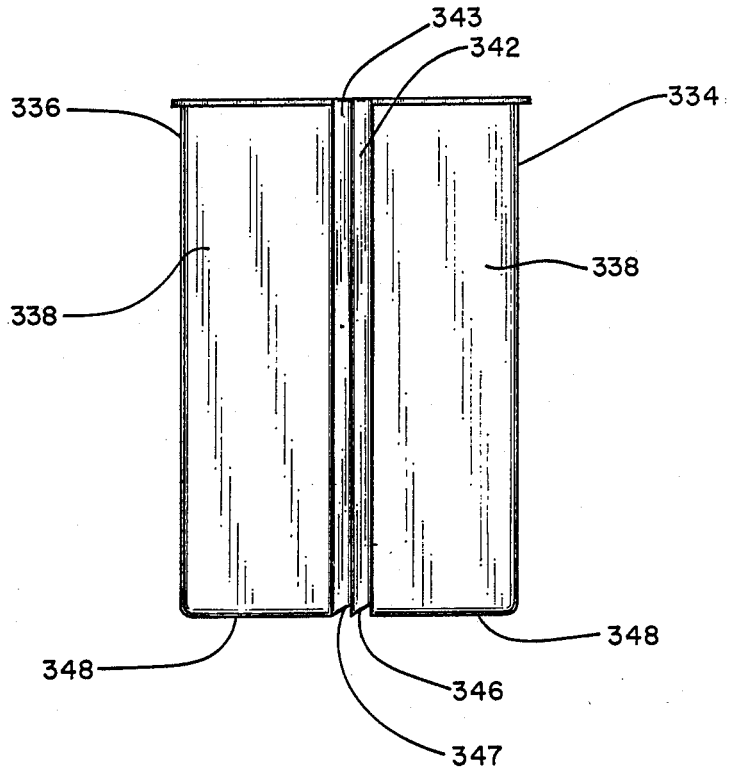
FIG. 18 shows an elevational end view of the container shown in FIG. 17.

Yet another embodiment of the invention is shown, in two variations, in FIGS. 16 and 17. It has been found that when using ridged metal or plastic ammunition containers, since the width of the containers must be greater than the length of the bullets which are stacked transversely therein, the ammunition tends to rattle, jiggle, and make noise as the container is transported. For example, when a soldier is running, the ammunition tends to rattle back and forth between the side walls making an undesirable amount of noise. In the embodiments of FIGS. 16 and 17, the side walls of the container are inwardly biased, resting in their normal position at a width approximately equal to, or slightly less than, the length of the M-60 bullets. When the ammunition is placed in the container, the side walls expand outwardly slightly from their resting width to accommodate the bullets, with the ends of the bullets contacting the interior surfaces of the side wall. The biasing force of the walls is sufficient to maintain the walls in contact with the bullets, but is not sufficiently strong to provide undesirable friction upon removal of the bullets from the container.

It has been found that the easiest way to provide inwardly biased container walls is to mold the container with slightly inwardly biased side walls, this being accomplished by means of a plurality of pleats in the walls which allows slight expansion of the walls from their resting condition. These pleats may either be in the side walls, as shown in FIG. 16, or in the end walls and bottom wall, as shown in FIG. 17. Referring first to FIG. 16, container 300 has opposing flat side walls 302 and 304, and opposing end walls 306 and 308. The mounting bracket 318 and strap hanger 310 are as previously described in other embodiments. The entire unit is molded out of one plastic part. A plurality of vertical pleats 310, 312, 314, and 316 extend the entire height of each side wall adjacent the end walls 306 and 308. These pleats are manufactured by standard molded techniques by machining a Z-shaped groove into the mold. The product exits the mold in a normally collapsed position, but can be expanded simply by pulling the sides apart. The effect is to permit the sides to be expanded away from each other with a slight bias or tendency to return to the contracted position. However, the bias is not sufficient to preclude the machinegun bullets from being easily removed from the container on demand. While the construction of complimentary pleats in the bottom portion of the side walls parallel to the bottom wall and adjacent thereto is contemplated (thus permitting the wall to expanded laterally in a relatively uniform manner), it has been found that the bottom pleat is not necessary to enable the container to function properly. The carrying strap 313 and strap hanger 311 are optional as in previous embodiments.

An alternate embodiment to the design of FIG. 16 is shown in FIG. 17, and is actually preferred thereto. In this embodiment, centrally located pleats are molded in the end walls and bottom wall of the container, separating the container into two vertical halves which are expandable along the pleats. As shown in the drawing, container 330 having a mounting bracket 332 has side walls 334 and 336, and end walls 338 and 340. In this manner, the container is similar to containers shown in the other drawings herein. However, side walls 334 and 336 are expandable along pleats in end walls 338 and 340 and in bottom wall 348. Pleats 342, 344, and 346 are effectively a single pleat which is molded around the entire periphery of the container; pleats 343, 345 and 347 comprise an adjacent pleat. As shown in FIG. 17, the pleats are shown in expanded position with bullet 350 touching both of the interior surfaces of side walls 334 and 336. When the bullets are removed from the container, the pleats relax into a closed position, drawing the side walls closer together. The molded mounting bracket 332 helps to provide an inwardly biasing force on side walls 334 and 336.

The number of pleats necessary in the walls of the embodiments shown in FIGS. 16 and 17 is a design variation that will depend on the size, shape, and thickness of each pleat. A single pleat can be used in each wall, although two or three pleats are preferred. Layer numbers of pleats can be functional but are unnecessary. The pleats function both as expansion means, allowing the opposed side walls to expand apart, but as biasing means which urge the walls toward each other when the pleats are expanded.

It will be readily apparent to those skilled in the art that a number of changes and alterations may be made within the spirit and scope of the invention without departing from the inventive concepts set forth earlier. Accordingly, the invention should not be considered limited by the specific embodiments thereof disclosed herein, but rather should be considered limited only by the following claims.

I claim:

1. A machinegun ammunition container for removably mounting on a bandolier supporter of a machinegun comprises a box having a bottom, enclosed walls, and an open top, a mounting strap comprising a flat, rigid member, spaced from and substantially parallel to a flat wall of the container, said mounting strap having first and second ends supportively mounted to the container, a vertical slot defined by the flat wall and the mounting strap substantially spanning the flat wall, said mounting strap being adapted to fit slideably over the bandolier supporter by extending the bandolier supporter through the vertical slot, and stabilizing means for reducing undesirable movement of the container when the container is mounted on the bandolier supporter of the machinegun comprising boss means extending inwardly from the mounting strap adapted to engage notch means on the bandolier supporter, and removable closure means for enclosing the container top, said closure means comprising a flat member having a rearward portion connected to a forward portion by hinge means, and lip means on a forward portion of said removable closure means adapted to contact an upper portion of the bandolier supporter upon placement of the container upon the bandolier supporter, thereby causing the forward portion of the closure means to retract from the container while the rearward portion of the closure means remains attached to the container.

2. The machinegun ammunition container of claim 1 also comprising expansion means for permitting a pair of opposed walls of the container to move between an expanded position and a retracted position, and biasing means for urging said opposed walls to the retracted position.

3. The machinegun ammunition container of claim 2 in which the expansion means comprises pleat means in opposed flat end walls of the container.

4. The machinegun ammunition container of claim 2 wherein the expansion means comprises U-shaped pleat means extending along opposed end walls of the container and a bottom wall thereof, said pleat means extending around an entire periphery of the container.

5. The container of claim 1 wherein the container is a one-piece molded plastic container.

6. The container of claim 1 in which the closure means is a molded plastic member, and the hinge means comprises a transverse crease formed in the flat member.

7. A machinegun ammunition container comprises a box having a bottom wall, first and second flat parallel side walls, and first and second opposed end walls, and mounting means for removably attaching the container to a machinegun, and expansion means for permitting the side walls to move between an expanded position and a retracted position said expansion means comprising U-shaped pleat means extending along said opposed end walls of the container and a bottom wall thereof, said pleat means extending around an entire periphery of the container.

8. A machinegun ammunition container for removably mounting on a bandolier supporter of a machinegun comprises a one-piece, molded plastic box having a bottom, opposed side walls, opposed end walls, and an open top, a mounting strap comprising a flat, rigid member, spaced from and substantially parallel to a flat wall of the container, said mounting strap having first and second ends supportively mounted to the container, a vertical slot defined by the flat wall and the mounting strap substantially spanning the flat wall, said mounting strap being adapted to fit slideably over the bandolier supporter by extending the bandolier supporter through the vertical slot, and stabilizing means for reducing undesirable movement of the container when the container is mounted on the bandolier supporter of the machinegun comprising boss means extending inwardly from the mounting strap adapted to engage notch means on the bandolier supporter, and expansion means for permitting the opposed side walls of the container to move between an expanded position and a retracted position, said expansion means comprising a plurality of molded vertical pleats in at least one container wall, said pleats extending from the bottom to the open top of the container.

9. The machinegun ammunition container of claim 8 in which the expansion means comprises pleat means in said opposed end walls of the container.

10. The machinegun ammunition container of claim 8 wherein the expansion means comprises U-shaped pleat means extending along said opposed end walls of the container and a bottom wall thereof, said pleat means extending around an entire periphery of the container.

11. The container of claim 8 also comprising removable closure means for enclosing the container top, wherein the closure means is slideably attached to container walls forming the open top of the container.

12. The container of claim 8 also comprising removable closure means for enclosing the container top, said closure means comprising a flat member having a rearward portion connected to a forward portion by hinge means, and lip means on a forward portion of said removable closure means adapted to contact an upper portion of the bandolier supporter upon placement of the container upon the bandolier supporter, thereby causing the forward portion of the closure means to retract from the container while the rearward portion of the closure means remains attached to the container.

13. The container of claim 12 in which the closure means is a molded plastic member, and the hinge means comprises a transverse crease formed in said member.

* * * * *